United States Patent [19]

Schenke et al.

[11] Patent Number: 4,734,950

[45] Date of Patent: Apr. 5, 1988

[54] CLEANING APPARATUS FOR EXTERIOR OF ELONGATED MEMBERS

[75] Inventors: Reynold A. Schenke; Robert W. Schenke; Michael A. Schenke, all of Paradise, Pa.

[73] Assignee: Schenke Tool Co., Paradise, Pa.

[21] Appl. No.: 32,238

[22] Filed: Mar. 31, 1987

[51] Int. Cl.[4] ..... B08B 9/02

[52] U.S. Cl. ..... 15/88; 15/104.04; 15/104.92

[58] Field of Search ..... 15/88, 104.04, 40, 104.92; 29/81 F; 118/DIG. 11

[56] References Cited

U.S. PATENT DOCUMENTS

| | | | |
|---|---|---|---|
| 2,637,056 | 5/1953 | Morain | 15/88 |
| 3,189,935 | 6/1965 | Euga . | |
| 3,405,417 | 10/1968 | Hitt | 15/88 |
| 3,471,885 | 10/1969 | McLoughlin . | |
| 3,530,526 | 9/1970 | Schmidt . | |
| 3,903,561 | 9/1975 | McCaslin | 15/88 |
| 4,280,672 | 7/1981 | Santos . | |
| 4,502,175 | 3/1985 | Hillis . | |
| 4,503,577 | 3/1985 | Fowler . | |

*Primary Examiner*—Edward L. Roberts

*Attorney, Agent, or Firm*—Fleit, Jacobson, Cohn & Price

[57] ABSTRACT

A cleaning apparatus for elongated articles such as lengths of tubing or bar stock has a cleaning housing through which an article is passed axially for cleaning. Inside the housing is an array of helically disposed brushes which wipe the outer surface of the article as it is passed between them. Cleaning solvent is circulated through the housing. The brushes are circumferentially disposed and helically oriented to define a central tunnel through which the article is passed and the diameter is such that the brushes wipe the outer surface of the articles. The helical disposition of the brushes insures that the entire outer surface is wiped. The housing has adjustable end plate assemblies allowing the position of the brushes to be varied so that different diameter articles can be accommodated. The apparatus also includes a resilient wiper ring at the outlet of the housing through which the elongated articles pass for the removal of moisture from their surfaces.

8 Claims, 2 Drawing Sheets

CLEANING APPARATUS FOR EXTERIOR OF ELONGATED MEMBERS

BACKGROUND OF THE INVENTION

This invention relates to an apparatus for use in cleaning the exteriors of elongated articles such as elongate rods, bars, tubes and the like without having to accommodate the entire article during cleaning. For example, metal bar stock and the like may be supplied to a user with a rust-protective mill oil film on the outer surfaces, and it is generally desirable to remove such film prior to performing manufacturing processes on the material in order to protect operators and equipment from the oily film and to limit the collection of grime and dirt on the material.

It is generally impractical to fabricate cleaning tanks of sufficient length to accommodate entire bars, rods and the like in all of the lengths generally encountered in engineering practice. Accordingly, it is an object of the present invention to provide a cleaning apparatus for the purpose indicated which is of a compact size and which allows an elongate article of substantially any length, longer than the apparatus, to be cleaned by moving the article lengthwise through the apparatus.

Another object of the invention is to provide a cleaning apparatus as referred to which allows cleaning to take place in an enclosed environment in which an operator is not exposed to possibly harmful cleaning fluids and/or fumes.

Still another object of the invention is to provide a cleaning apparatus as referred to wherein an elongate article to be cleaned is passed lengthwise through a cleaning station in which the exterior of the article is engaged by surrounding cleaning brushes and which has the facility for adjusting the positioning of the brushes to accommodate articles of different diameter.

Applicant is aware of the following U.S. patents pertaining to cleaning devices for elongate articles and the like. None of the patents, however, discloses a cleaning apparatus having the features of the present invention:

U.S. Pat. No. 2,637,056, May 5, 1953
U.S. Pat. No. 3,189,935, June 22, 1965
U.S. Pat. No. 3,471,885, Oct. 14, 1969
U.S. Pat. No. 3,530,526, Sept. 29, 1970
U.S. Pat. No. 3,903,561, Sept. 9, 1975
U.S. Pat. No. 4,280,672, June 28, 1981
U.S. Pat. No. 4,502,175, Mar. 5, 1985
U.S. Pat. No. 4,503,577, Mar. 12, 1985

SUMMARY OF THE INVENTION

Broadly stated, a cleaning apparatus in accordance with the invention includes an elongate, substantially enclosed cleaning housing having an inlet at one end, an outlet at the other end to enable an elongated article for cleaning to be passed lengthwise through the housing in an axial path extending between the inlet and the outlet, an array of elongated brushes enclosed within the housing, the brushes being arranged in circumferentially spaced positions surrounding said path, and each brush extending helically from one end to an opposite end of the brush, the apparatus further including means for circulating a cleaning medium through the housing.

The brushes preferably are each of circular cross section and are disposed so as to define an axial tunnel or the like therebetween through which the member for cleaning is passed. The diameter of the tunnel is determined by the size and spacing of the brushes and is related to the diameter of a workpiece for cleaning so that the brushes wipe the workpiece as it is passed through the tunnel, the helical disposition of the brushes, which are preferably four in number, insuring that substantially the entire outer surface of the workpiece is cleaned. The cleaning medium, normally a cleaning solvent or the like, may be suppled to the brushes by gravity from a fitting in a roof portion of the housing, and may drain through outlets in a base portion of the housing. The housing may be supported in an outer tank into which the solvent is drained and from which it may be removed and recirculated by a suitable solvent pumping system. The apparatus may also include an annular resilient wiper ring adjacent the outlet of the housing through which the workpiece passes to remove excess cleaning fluid from the outer surface.

In a preferred form of the invention, the ends of the brushes, which may be in the form of axially projecting wires or the like, are mounted in slotted housing end plate assemblies each of which includes a fixed slotted plate and an adjacent rotatable slotted plate with the brush ends extending through registered slots in the respective plates, and the configuration of the slots being such that rotation of the respective rotary plates at the opposite ends of the housing is effective, through interaction of the slots, to adjust the positioning of the brushes in a manner varying with the diameter of the tunnel therebetween through which a workpiece is passed, thereby allowing the apparatus to clean different diameter workpieces.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 3:
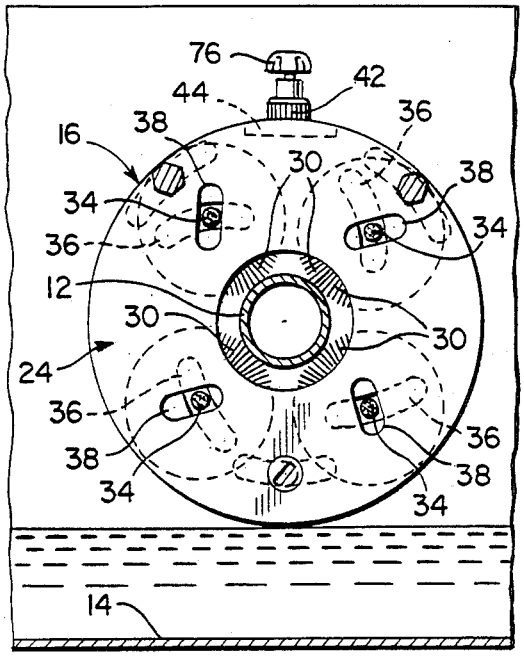
FIG. 3 is a sectional view on line 3—3 of FIG. 2.
Figure 4:
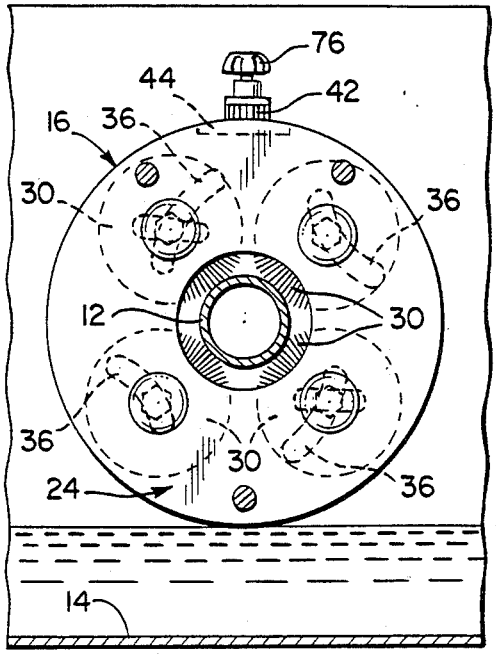
FIG. 4 is a sectional view on line 4—4 of FIG. 2.
Figure 1:
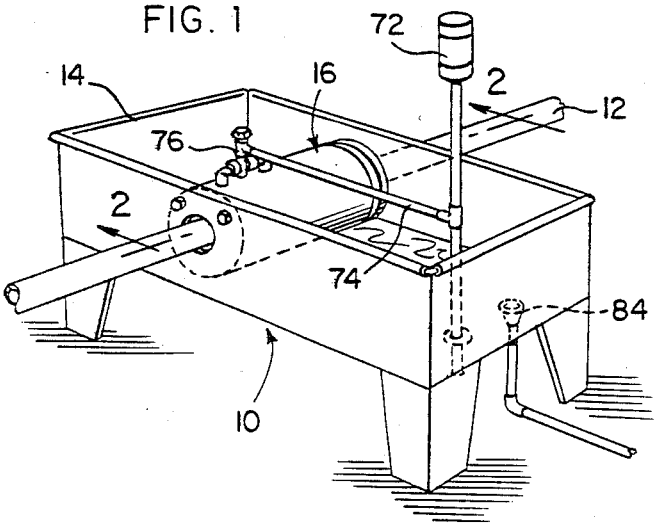
FIG. 1 is a perspective view of a cleaning apparatus in accordance with the invention.

Referring initially to FIG. 1, there is illustrated a cleaning apparatus 10 in accordance with the invention, particularly for cleaning oil film or the like from an elongated member, such as a metal tube, pipe or bar 12. Apparatus 10 includes a holding and circulating tank 14 for a cleaning fluid or solvent, and a generally cylindrical housing 16 supported in the tank, in a manner to be described, and through which member 12 is passed for cleaning.

In more detail, housing 16 comprises a cylindrical shell 18 with opposite end walls 19, and plate assemblies each formed from a stationary circular plate 24 and a rotary circular plate 26 on the outsides of end walls 19. Plates 24 and 26 as well as end walls 19 all have similar centralized apertures 28 forming respectively an inlet and an outlet for member 12 at opposite ends of the housing 16. Internally, housing 16 has an array of four elongate brushes 30 extending between the plate assemblies and being supported thereby in a manner to be described. Each brush may be of a well known form comprising bristles trapped by a central elongate wire core or shaft 34, the bristle assembly as a whole having a circular cross section, and the core 34 being formed lengthwise into helical form so that the brushes extend helically between the plate assemblies while defining an axial tunnel therebetween through which member 12 is passed for cleaning with the bristles engaging the outer surface of member 12 and the helica disposition of the brushes insuring that substantially the entire outer surface area of member 12 is wiped by the bristles as it is passed through the tunnel.

Figure 5:
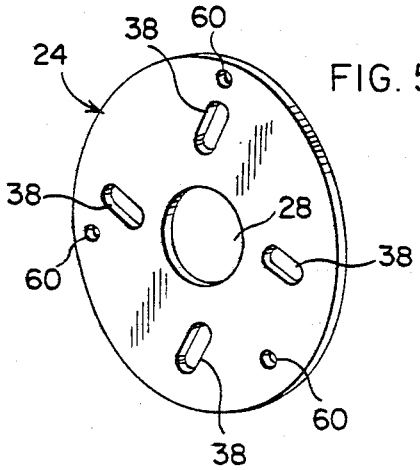
FIG. 5 is a perspective view of a stationary end plate component of the apparatus.
Figure 6:
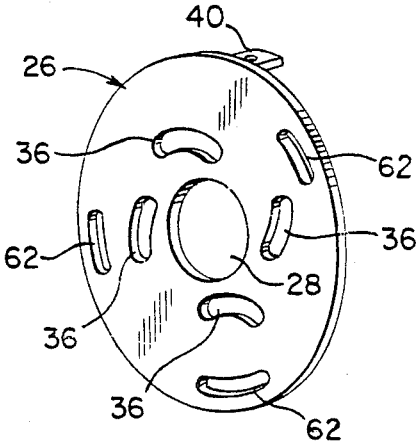
FIG. 6 is a perspective view of a rotary end plate component of the apparatus.
Figure 2:
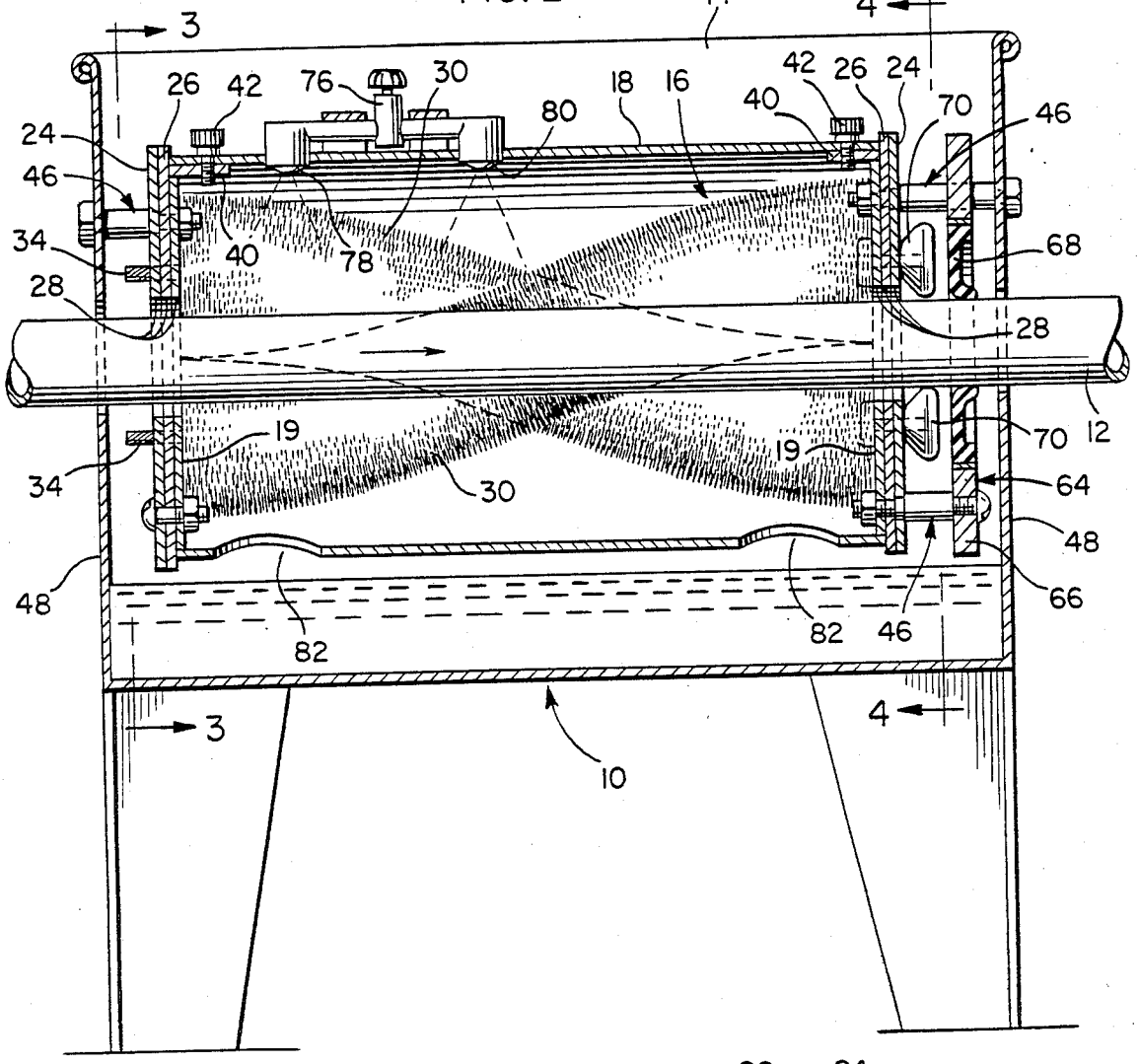
FIG. 2 is an enlarged sectional view on line 2—2 of FIG. 1.
Figure 7:
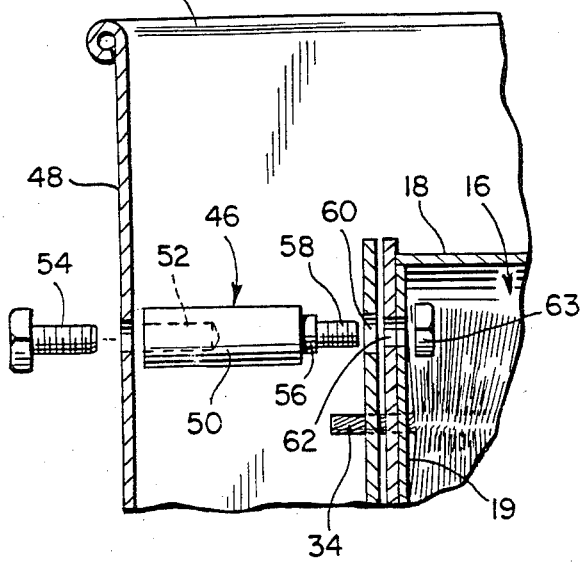
FIG. 7 is a further enlarged part-sectional view of a part of the apparatus.
Figure 8:
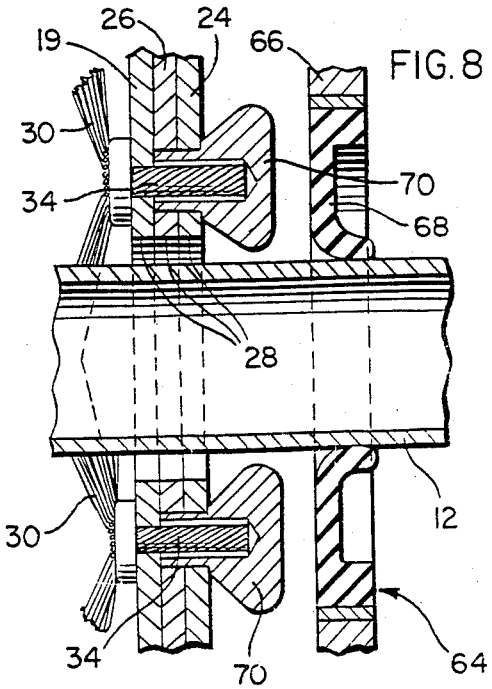
FIG. 8 is a part-sectional view of another part of the apparatus.

Each of the rotary end plates 26 (FIG. 6) has four outwardly radiating arcuate slots 36, and each of the stationary end plates 24 has four aligned outwardly directed slots 38 (FIG. 5). End walls 19 of shell 18 also have slots (not shown) equivalent to slots 38. When plates 24 and 26 are assembled together face to face, the slots 36 and 38 are in register and the respective ends of the brush cores 34 are received in and supported by the respective slots. Due to the different alignment and configuration of slots 36 and 38, however, as plate 26 is rotated relative to plate 24, the brushes are forced inwardly or outwardly along slots 38 so as to change the spacing between the brushes, thereby varying the diameter of the tunnel defined therebetween through which the workpiece is passed, and effectively adjusting the capacity of the apparatus to clean different diameter workpieces. In order to rotate plates 26, they are each provided with a rearwardly extending stem attachment 40 into which is threaded a screw-knob 42 extending through a lateral slot 44 in shell 18. End walls 19 are also slotted to receive stem attachments 40.

Plates 24 and 26 are secured to shell 18 by screw assemblies 46 which also suspend the housing 16 between sidewalls 48 of tank 14. There may be three equally circumferentially spaced assemblies 46 at each end of the housing, and each screw assembly may include a stud 50 with a threaded blind bore 52 at one end for receiving a screw 54 extending through an aperture in tank wall 48. At its opposite end, stud 50 may have a reduced diameter portion 56 with a threaded end 58. Portion 56 may extend through a respective aperture 60 in plate 24, an arcuate slot 62 in plate 26, and a respective aperture in plate 19. A nut 63 may be welded to the interior of plate 19 to receive the threaded end 58 of stud 50.

At the outlet end of housing 14, the apparatus may include a wiper assembly 64 comprising a housing 66 and an annular seal-type wiper 68 therein, wiper 68 being of a resilient material, known per se, for example, Vitron. Housing 66 may, for example, be mounted by any convenient means between the respective screw assemblies 46. The central opening of the wiper is centered on the outlet of housing 14, and the flexibility of its lip-type structure enables different diameter workpieces to be wiped of moisture remaining on the workpiece after passage through housing 14.

In order to guide a workpiece into the wiper 68, guide knobs 70 may be screwed onto ends 40 of the brush cores at the outlet end of housing 14. The knobs 70 adjust with the brushes responsive to rotary movements of plates 26, and sized so that their inner edges engage and guide a workpiece as it exits housing 14.

Cleaning fluid from tank 14 may be circulated through housing 16 by a pump 72 and tubing 74 which supplies the fluid to a fitting 76 in a roof portion of shell 18, fitting 76 having two outlets 78, 80 which supply the fluid by gravity upstream and downstream to the brushes 30 so that the workpiece 12 is thoroughly cleaned as it is passed through the housing. The cleaning fluid may drain back into tank 14 through drain outlets 82 in the bottom of the shell 18. Tank 14 may be provided with a drain outlet 84 and a lid not shown.

It will be apparent from the foregoing that the apparatus as described above is well adapted to the objects of the invention and provides a convenient as well as an effective and compact means for cleaning elongated articles of different diameters.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling withing the scope of the invention.

What is claimed as new is as follows:

1. Apparatus for cleaning the exterior of elongated articles such as lengths of bar stock, tubing, and the like comprising an elongate substantially enclosed housing having an inlet at one end and an outlet at the other end for enabling an elongated article for cleaning to be passed lengthwise through the housing in an axial path extending between the inlet and the outlet, an array of elongated brushes disposed within the housing, the brushes being arranged in circumferentially spaced positions surrounding said path, and each brush extending helically from one end thereof to the other end thereof, the brushes together defining an elongate axially extending cleaning tunnel therebetween for the elongate articles to pass through between the inlet and the outlet of the housing, the apparatus further including means for circulating a cleaning medium through the housing.

2. The invention as defined in claim 1 wherein the brushes are each of circular cross section.

3. The invention as defined in claim 1 wherein the housing includes slotted end plate assemblies in which opposite ends of the respective brushes are mounted, each end plate assembly comprising a fixed plate and an adjacent rotary plate, and registering slots in the respective plates with the ends of the brushes being received and supported in the registering slots, the configuration of the slots being such that rotation of the rotary plates causes the brushes to move in the slots of the respective fixed plates so as to vary the spacing between the brushes effectively adjusting the diameter of said tunnel and enabling the apparatus to accommodate workpieces of different diameters.

4. The invention as defined in claim 3 further including an annular resilient wiper ring adjacent the outlet of the housing for the elongated articles to pass through on exit from the housing for wiping moisture from the elongated articles.

5. The invention as defined in claim 4 wherein the ends of the brushes at the outlet of the housing each carry a guide knob for engaging the elongate articles and guiding same into the wiper ring, the positions of the guide knobs being adjusted in concert with the positions of the brushes upon rotation of the rotary plates.

6. The invention as defined in claim 1 wherein the housing is mounted in a cleaning fluid holding tank, and the means for circulating fluid through the housing includes a fitting in a roof portion of the housing for receiving fluid pumped from the tank and supplying same by gravity onto the brushes, and drain means in a base portion of the housing for returning the fluid to the housing.

7. The invention as defined in claim 6 wherein the fitting has a pair of outlets for discharging fluid upstream and downstream onto the brushes.

8. The invention as defined in claim 6 wherein the housing is suspended between opposite walls of the tank having apertures therein aligned with the housing inlet and outlet.

* * * * *